United States Patent [19]

Ellingson et al.

[11] Patent Number: 4,510,777

[45] Date of Patent: Apr. 16, 1985

[54] CONTROL SYSTEM FOR AN ACCESS DOOR

[75] Inventors: David I. Ellingson; James D. Wilson, both of Newton, Iowa

[73] Assignee: The Maytag Company, Newton, Iowa

[21] Appl. No.: 565,734

[22] Filed: Dec. 27, 1983

[51] Int. Cl.[3] ..... D06F 33/02; D06F 37/28

[52] U.S. Cl. ..... 68/12 R; 200/61.64; 134/57 DL

[58] Field of Search ..... 68/12 R, 23 R; 200/61, 200/61.62, 61.64, 61.7; 134/57 DL, 58 DL

[56] References Cited

U.S. PATENT DOCUMENTS

| | | | |
|---|---|---|---|
| 3,440,373 | 4/1969 | Blewitt, Jr. | 200/61.7 |
| 3,546,410 | 12/1970 | Brighenti | 200/61.62 X |
| 3,627,960 | 12/1971 | Grabek | 200/61.64 |
| 3,638,457 | 2/1972 | Filipak | 68/12 R |
| 3,673,824 | 7/1972 | Ripsco | 68/12 R |

FOREIGN PATENT DOCUMENTS

| | | | |
|---|---|---|---|
| 1132228 | 9/1982 | Canada | 68/12 R |

*Primary Examiner*—Philip R. Coe
*Assistant Examiner*—Frankie L. Stinson
*Attorney, Agent, or Firm*—Richard L. Ward

[57] ABSTRACT

A control system is provided for operating a washing machine through a cycle of operations and for ensuring that an access door is closed and locked during predetermined portions of the cycle and for ensuring that sensor switches are properly operable. A microcontroller-based programmer controls the washing machine through the cycle of operations. A first switch is actuatable by the access door for enabling energization of the washing machine upon movement of the access door to the closed position and a latch mechanism is energizable by the programmer for positioning the latch mechanism to effect the locking of the access door in the closed position if the first switch is closed. A second switch is in circuit with the programmer and is operable from a first to a second posture upon locking of the access door to provide a door-latched signal to the programmer. The programmer is further operable for effecting a signal to the second switch and for receiving a verification signal with the second switch in the first posture to confirm the proper operability of the second switch upon receiving the door-latched signal. The programmer is operable for verifying the second posture of the second switch throughout at least preselected portions of the cycle of operations and is operable for terminating operation of the washing machine upon detecting an inoperable second switch or an unlatched access door.

6 Claims, 7 Drawing Figures

CONTROL SYSTEM FOR AN ACCESS DOOR

BACKGROUND OF THE INVENTION

This invention relates generally to the field of locking systems for laundry appliance access doors. The access door of a microcontroller operated laundry appliance is manually closed to mechanically operate a line switch and to position a latch member for locking the access door closed. A solenoid is actuated by the microcontroller to lock the access door in the access-closed position and to close the contacts of a second switch for providing a door-latched signal to the microcontroller. The second switch is addressed by the microcontroller prior to locking the access door for confirming the proper operability of the second switch upon receiving the door-latched signal. The microcontroller is operable for verifying the posture of the second switch throughout preselected portions of the cycle and is operable for interrupting operation of the washing machine upon detecting an inoperable second switch or an unlocked access door.

Prior art locking systems for appliances which include rotatable members have generally utilized door locking mechanisms which provide for simply mechanically locking the access door during periods of high speed spin.

Harrold, U.S. Pat. No. 3,763,670, teaches an automatic clothes washing machine where closing of the lid moves a slide to close a first switch. Closing of the first switch conditions a solenoid circuit for actuating a locking arm into engagement with the slide for locking the lid and closing a second switch when the timer spin switch is closed. The second switch and solenoid are thus in the spin circuit of the drive motor and the lid is locked only when the washing machine is in spin and spin will proceed only when the second switch is closed.

Lay et al, U.S. Pat. No. 3,857,002, disclose appliance structure where a main switch is closed by movement of door lock structure to the locked posture. The structure includes a solenoid for moving a pin to lock the access door only when the access door is closed. If the access door is not locked the appliance will not be operable. The solenoid is connected in the control circuitry by two parallel lines, each having a switch so that one switch is closed whenever the appliance is on and the other switch is closed only when the machine is in spin. Thus, the door cannot be unlocked during spin.

The prior art does show circuitry and mechanism for locking an access door during selected periods of appliance operation, during an entire cycle of operation and for preventing operation of the appliance if the access door is not closed. There has been no known showing, however, of a microcontroller-based access door locking system for ensuring that the access door is closed and locked during predetermined portions of a cycle of operations and for ensuring that sensor switches associated with the access door are properly operable.

SUMMARY OF THE INVENTION

It is therefore an object of the instant invention to provide an improved access door locking system for a laundry appliance.

It is a further object of the instant invention to provide a control system for ensuring that the access door is closed and locked and that sensor switches associated with the access door are properly operable.

Briefly, the instant invention achieves these objects in a washing machine including a control system for operation of the washing machine through a cycle of operations and for ensuring that an access door is closed and locked during predetermined portions of the cycle of operations. The control system is also operable for ensuring that sensor switches associated therewith are properly operable. A cabinet is associated with the washing machine and includes a top cover defining an access into washing apparatus. An access door is mounted on the top cover and is movable between access-open and access-closed positions. Circuitry includes a microcontroller-based programmer for controlling the washing machine through the cycle of operations. Latch mechanism is operable under control of the programmer with the access door in the access-closed position for locking the access door in the access-closed position. A switch is associated with the circuitry and is actuatable from a first posture to a second posture by the latch mechanism upon locking the access door to provide a door-latched signal to the programmer. The programmer is operable for addressing the switch prior to the actuation thereof and for receiving a verification signal with the switch in the first posture to confirm the proper operability of the switch upon receiving the door-latched signal. The programmer is operable for verifying the second posture of the switch throughout preselected portions of the cycle of operations whereby the circuitry is operable for interrupting operation of the washing machine upon detecting an inoperable switch or an unlocked access door during the preselected portions.

Operation of the lock and control system and further objects and advantages thereof will become evident as the description proceeds and from an examination of the accompanying four sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
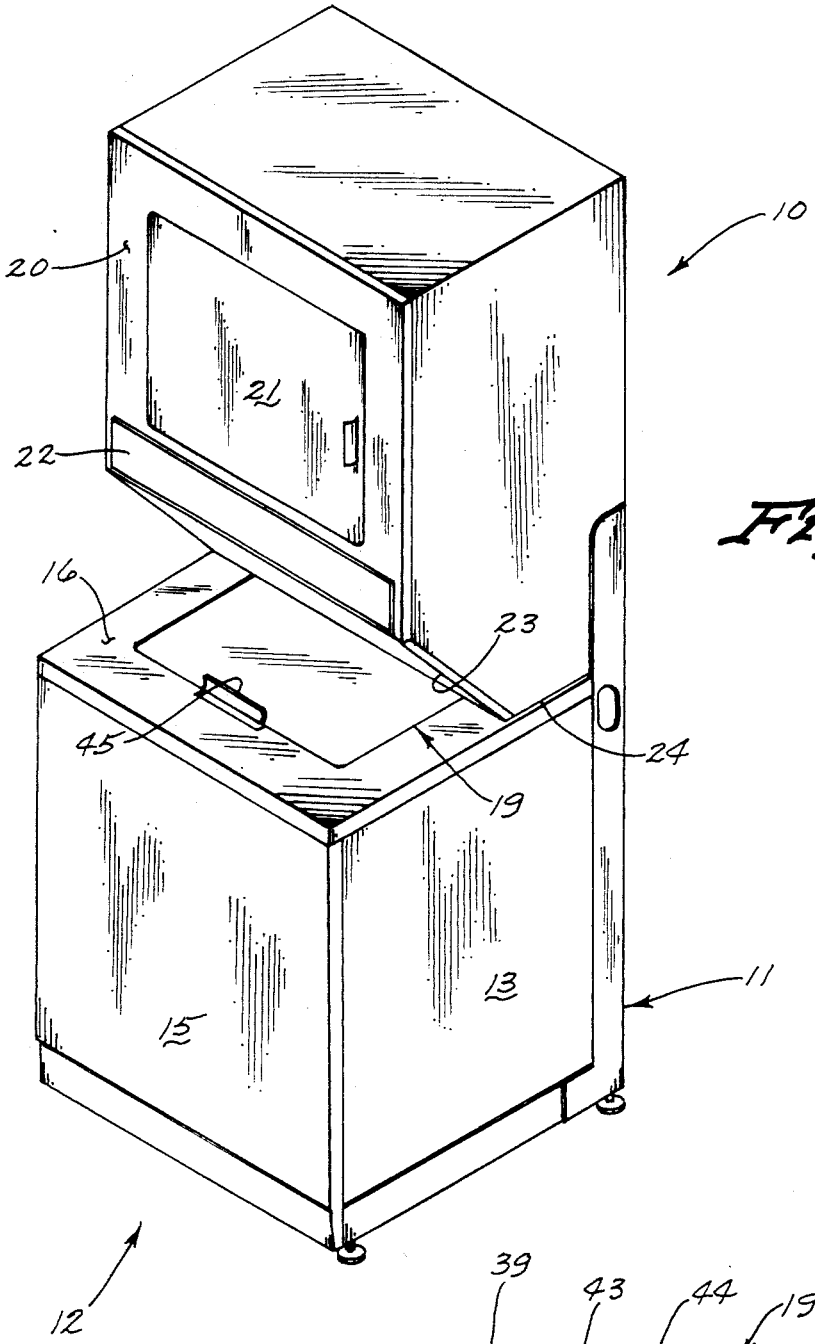
FIG. 1 is an isometric view of a washer/dryer pair mounted in a stack arrangement through a support stand.

Referring now to the drawings and in particular to FIG. 1, there is shown a pair of laundry appliances with a fabric dryer 10 mounted on an appliance support stand 11 above an automatic washing machine 12.

Briefly, in this embodiment of the invention, the automatic washing machine 12 is housed within a generally rectangular cabinet having a three-sided enclosure member forming the sides 13 and rear 14 of the cabinet. A vertically oriented front panel 15 completes the peripheral cabinet of the washing machine 12. The cabinet of the washing machine 12 also includes a substantially horizontally disposed top cover 16 having a slidable access door 19 for providing access to the interior of the washing machine 12.

The fabric dryer 10 is shown mounted in a cantilevered fashion on the support stand 11 directly above the washing machine 12 and also has a generally rectangular enclosure which is substantially shorter in front-to-back depth than that of the washing machine 12. The vertically oriented dryer front panel 20 includes an access door 21 for loading and unloading fabrics to be dried. Controls, such as control panel 22, may be positioned on the dryer 10 and/or washer 12 through which the washing machine 12 and dryer 10 are controlled. As further shown in FIG. 1, the lower front panel portion 23 of the dryer 10 tapers rearwardly from a point adjacent the bottom edge of the control panel 22. The lower edge 24 of the dryer lower front panel 23 is adjacent to but is spaced slightly above the top cover 16 of the washing machine 12. The dryer heater and drive assembly (not shown) are located within the lower part of the dryer 10 behind the sloping lower front panel 23.

Figure 2:
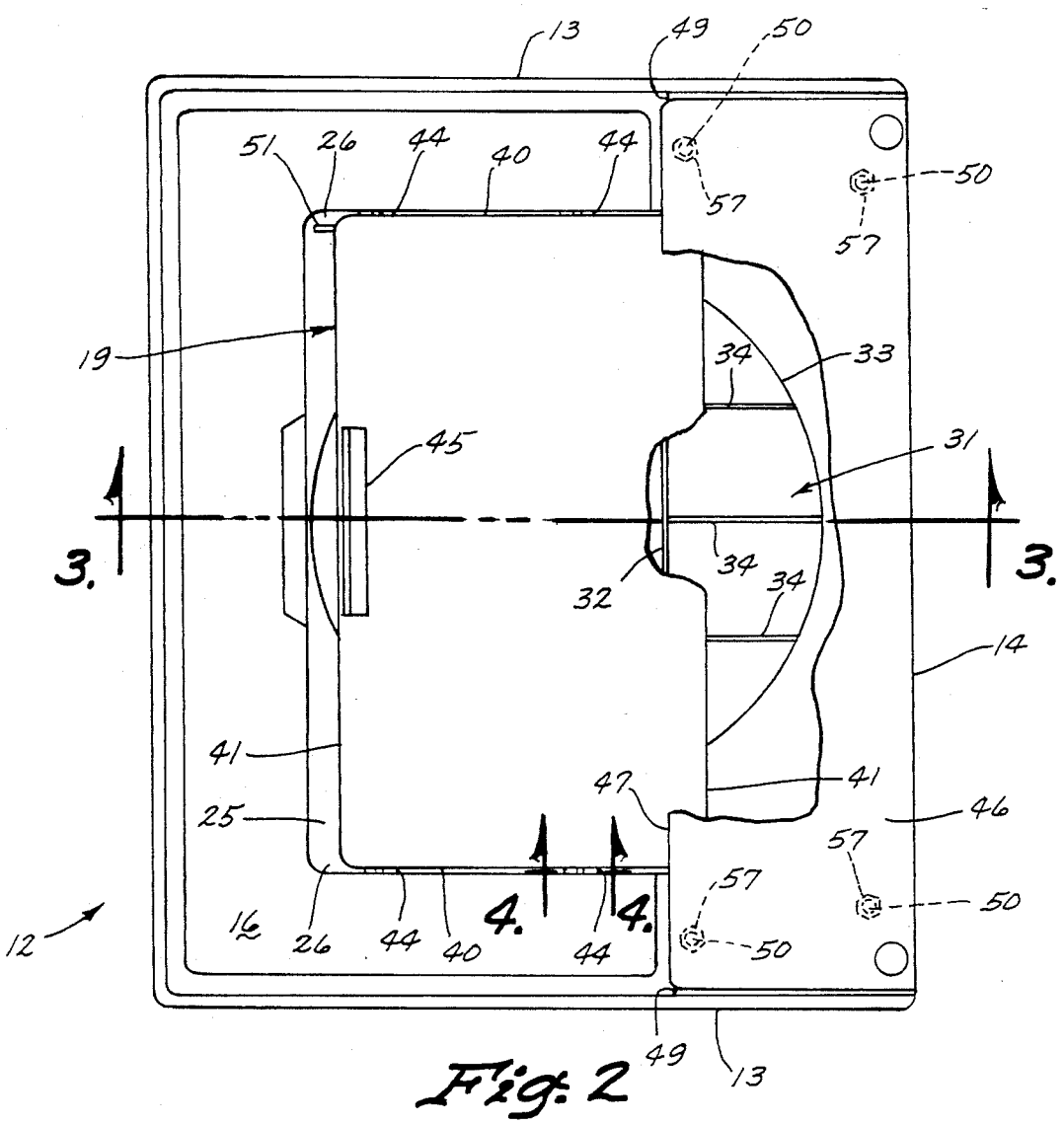
FIG. 2 is a top plan view of the washing machine.
Figure 3:
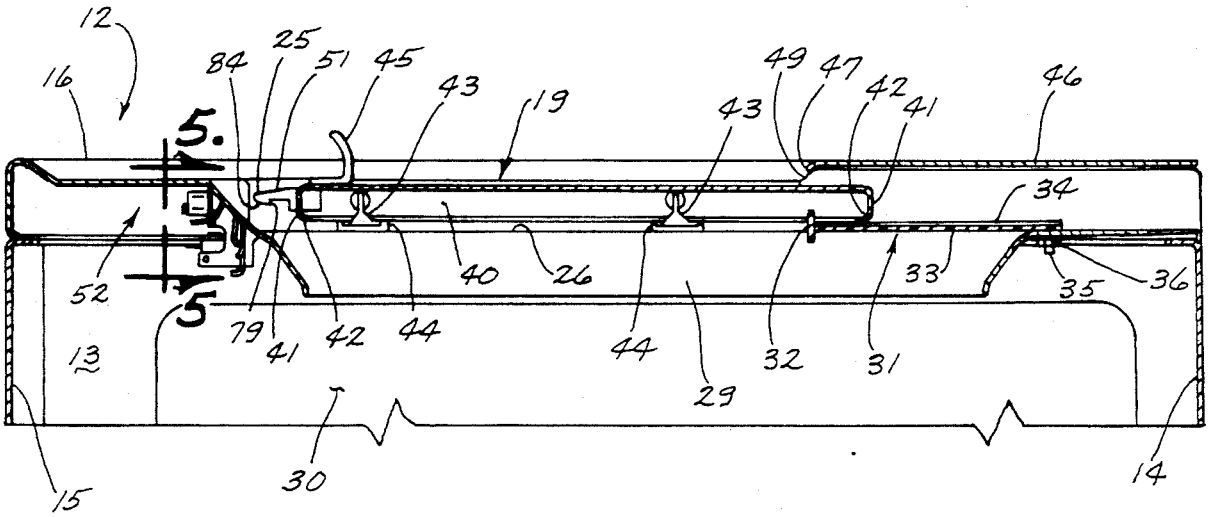
FIG. 3 is a section view of the top portion of the washing machine taken generally along lines 3—3 of FIG. 2.

Referring now to FIGS. 2 and 3, there is shown a top plan view and a cross sectional view of the top cover 16 of the washing machine 12 in FIG. 1. As previously discussed relative to FIG. 1, the top cover 16 completes the enclosure of the washing machine 12 and is generally rectangular in shape. The top cover 16 includes a generally centrally located rectangular depression 25 which has a substantially flat front-to-rear area on either side defining guideways 26 for receiving the front-to-rear movable sliding access door 19. As best shown in FIG. 3, the rectangular depression 25 of the top cover 16 extends downwardly into a tapered substantially circular tub access opening 29 for loading and unloading clothes into and out of the tub 30.

In this embodiment of the invention, approximately the rear quarter of the circular tub access opening 29 is covered by a thermoplastic splash guard 31. As best shown in FIG. 2, the splash guard 31 is semicircular in configuration and, as shown in FIG. 3, is substantially flat and of uniform cross section. A front wall 32 extends equally above and below the horizontally disposed body 33 of the splash guard 31. The body 33 of the splash guard 31 includes a plurality of front-to-rear ribs 34 for strengthening and maintaining flatness. The splash guard 31 also includes a plurality of molded studs 35 which extend downwardly through the top cover 16 to receive threaded fasteners 36 for securing the splash guard 31 to the top cover 16.

Figure 4:
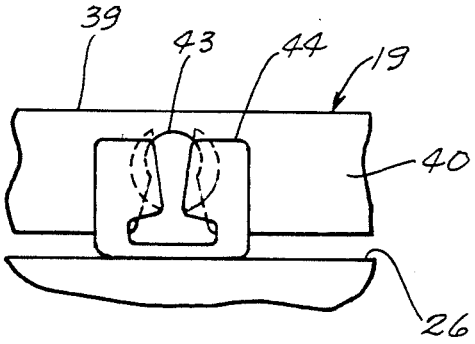
FIG. 4 is a fragmentary section view taken generally along lines 4—4 of FIG. 2 and shown out cf order on sheet 1.

As further shown in FIGS. 2 and 3, the sliding access door 19 cooperates with the splash guard 31 to cover the tub access opening 29. The access door 19 is generally rectangular in shape and is sized to mate with the rectangular depression 25 in the top cover 16. The access door 19 has a substantially flat horizontally disposed top, vertical side walls 40, vertical end walls 41 and a bottom peripheral edge or lip 42. The side walls 40 of the access door 19 each further include a pair of spaced-apart keyhole-shaped apertures 43 for receiving thermoplastic glides 44 as best shown in FIGS. 3 and 4. A handle 45 is mounted on top of the access door 19 for manually sliding the access door 19 back and forth along guideways 26 to cover and uncover the tub access opening 29.

Referring again to FIGS. 2 and 3, there is shown a sheet metal bridge 46 which extends from side to side across the rear of the top cover 16. The bridge 46 is mounted on raised segments 49 at each side of the top cover 16 for positioning the front edge 47 of the bridge 46 slightly above the rear of the access door 19 as shown in FIG. 3. The bridge 46 is secured to the raised segments 49 through a plurality of weld studs 50 which extend through the raised segments and which receive threaded fasteners 57 on the underside of the top cover 16. As can be seen in FIG. 3, when the splash guard 31 is secured to the top cover 16, the sliding access door 19 is operably positioned in the depression 25, and the bridge 46 is secured, the access door 19 will be nonremovable. The bottom lip or edge 42 at the rear of the access door 19 will engage that portion of the front wall 32 of the splash guard 31 which extends upwardly and the front edge 47 of the bridge 46 will engage with the top of the access door 19 if an attempt should be made to remove it. The access door 19 may be removed from the rectangular depression 25 for servicing by first removing the bridge 46 from the top cover 16.

With the access door 19 placed in the guideways 26 of the rectangular depression 25, the access door 19 is manually slidable by the handle 45 from a forward or closed position to a rearward or open position for providing access to the interior of the tub 30 of the washing machine 12.

Figure 5:
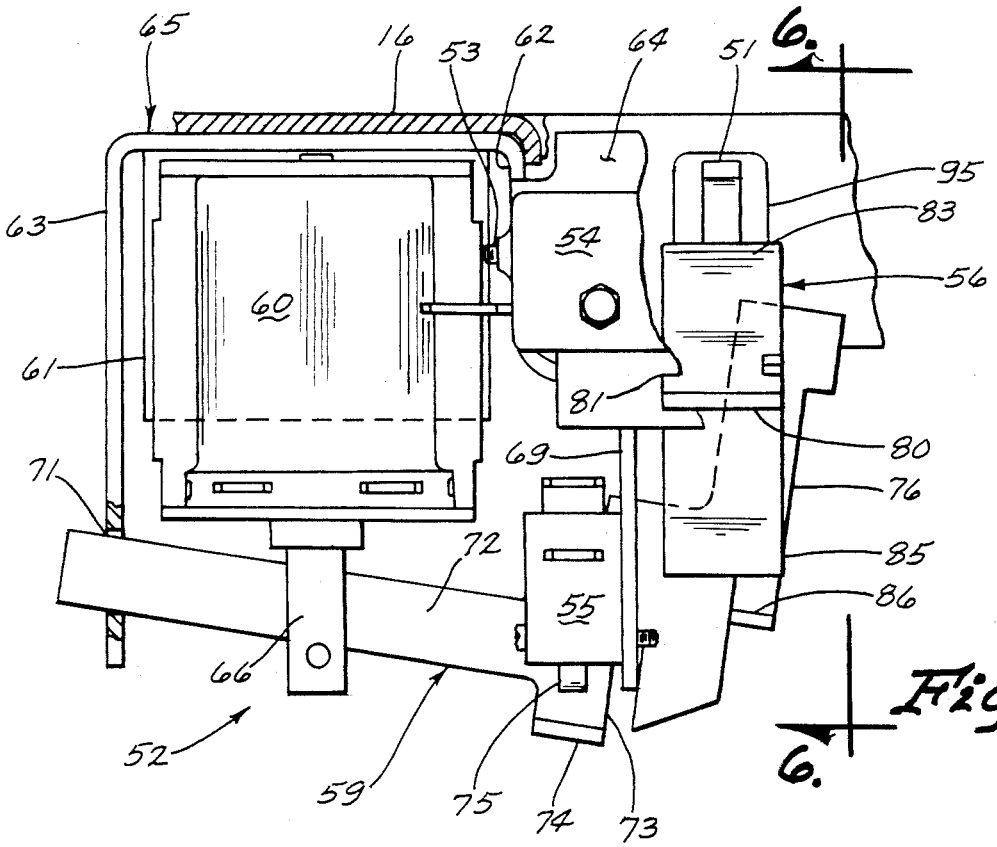
FIG. 5 is a fragmentary section view taken generally along lines 5—5 of FIG. 3 showing an enlarged view of the access door latching apparatus.
Figure 6:
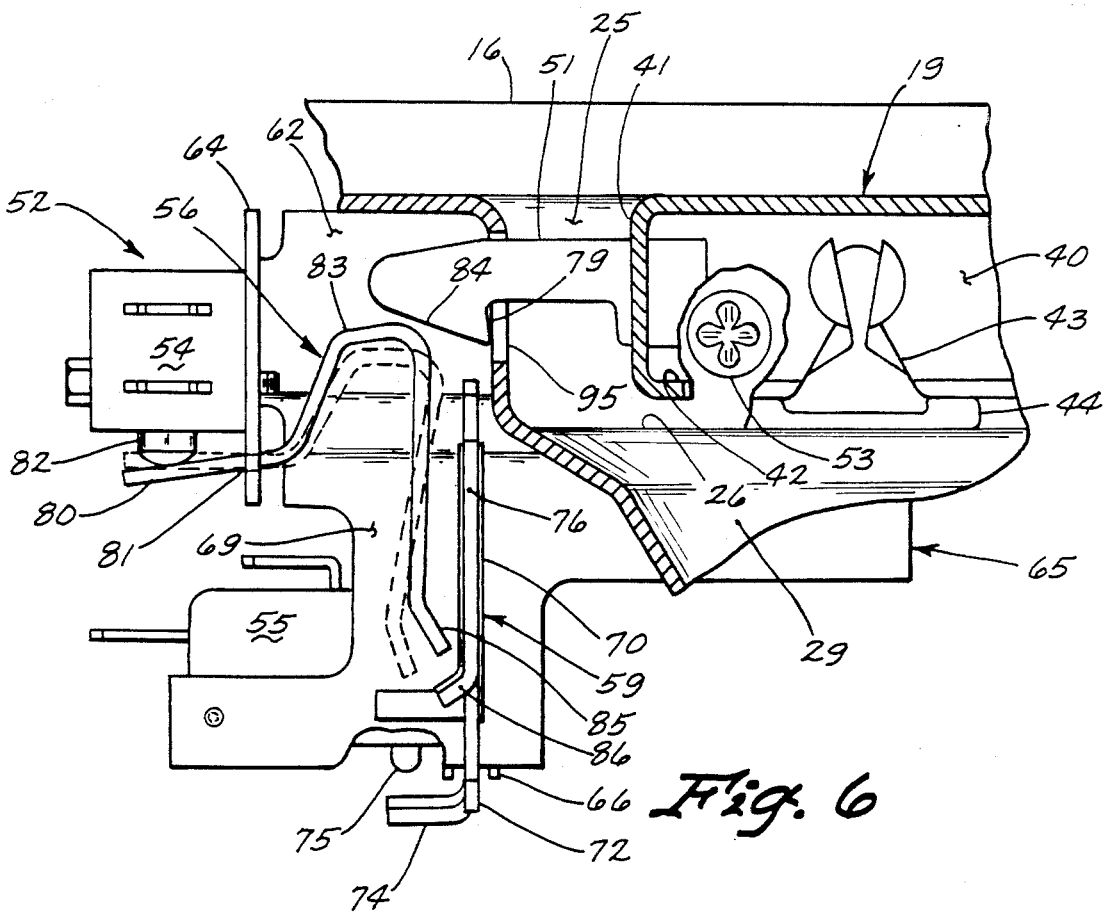
FIG. 6 is a fragmentary section view taken generally along lines 6—6 of FIG. 5 showing the access door latching apparatus in a posture similar to that as in FIG. 3 but at an enlarged scale.

As shown in FIGS. 2, 3, 5 and 6, the left front corner of the access door, when viewed from the front of the washing machine 12, includes a forwardly extending catch hook 51. As best shown in FIGS. 5 and 6, a latching mechanism 52 is secured to the side wall of the rectangular depression 25 below the top surface of the top cover 16 by a single threaded fastener 53 which extends through the side wall of the depression 25 and into a flange 62 of the latching mechanism mounting bracket 65. The mounting bracket 65 is located in direct contact with the underside of the top cover 16 for preventing movement of the latching mechanism 52 about the fastener 53.

Referring specifically to FIGS. 5 and 6, the access door latching mechanism 52 is comprised of an assembly of switches 54 and 55, levers 56 and 59 and a solenoid 60 mounted in a cooperative arrangement on the four generally vertically oriented flanges 61–64 of the mounting bracket 65. FIG. 5 shows the solenoid 60 attached to the first flange 61 with the clevis or bifurcated end 66 of the downwardly extending solenoid armature. As further shown in FIG. 5, second and third generally vertical walls or flanges 62 and 63 are located on each side of the first or solenoid mounting flange 61. The right-hand or second vertical flange 62 is utilized for mounting the latching mechanism 52 to the top cover 16 through the fastener 53 which taps into the flange 62 and, as shown in FIG. 5, includes an extension portion 69 which is offset downwardly and to the right. The offset extension portion 69 of the second flange 62 is utilized for mounting a lock switch 55 which will be further discussed herein. The fourth flange 64 of the mounting bracket 65 is substantially an extension of flange 62 and is formed to be generally perpendicular to the second flange 62 for mounting an access door switch 54.

As further shown in FIGS. 5 and 6, the second and third flanges 62 and 63 contain vertically oriented slots 70 and 71 generally aligned in a common vertical plane when viewed in FIG. 6. As best shown in FIG. 6, the slot 70 in the second flange 62 is vertically elongated to allow pivotal movement of a generally L-shaped access door latch lever 59. As FIG. 5 indicates, a first leg 72 of the L-shaped access door latch lever 59 extends through the vertically elongated slot 70 in the offset extension portion 69 of the second vertical flange 62 of the mounting bracket 65, through the clevis 66 of the solenoid armature and through the slot 71 in the third vertical flange 63 of the mounting bracket 65. The first leg 72 of the L-shaped access door latch lever 59 includes a downwardly opening notch 73 which is engageable with the offset extension portion 69 of the second flange 62 of the mounting bracket 65 for maintaining the access door latch lever 59 in the posture of FIG. 5. The first leg 72 of the access door latch lever 59 also includes a tab 74 which is operably engageable with the actuator button 75 of the lock switch 55 when the solenoid 60 is actuated for pivoting the L-shaped access door latch lever 59 about the slot 71 in the thrid flange 63. The second leg 76 of the L-shaped access door latch lever 59 extends upwardly at substantially a right angle to the first leg 72 and the upper extremity thereof will be moved into locking engagement with the edge 79 of the catch hook 51 when the access door 19 is closed and the solenoid 60 is actuated for pivoting the L-shaped access door latch lever 59 in a counterclockwise direction about slot 71.

As best shown in FIG. 6, the fourth vertical flange 64 of the mounting bracket 65 mounts the previously mentioned access door switch 54. An access door switch lever 56 is pivotally mounted on the fourth flange 64 with one end portion 80 extending to the left through the pivot slot 81 for engaging with the actuator button 82 of the access door switch 54. The access door switch lever 56 further includes a radiused center portion 83 which extends upwardly and to the right of the pivot slot 81 and is generally aligned with a tapered cam segment 84 of the access door catch hook 51. The access door switch lever 56 further extends downwardly from the radiused center portion 83 and terminates in stop portion 85 which extends angularly to the right and is engageable with an abutment 86 formed in the second leg 76 of the L-shaped access door latch lever 59 to block actuation of the lock switch 55 should the solenoid 60 be actuated when the access door 19 is in an open posture.

Figure 7:
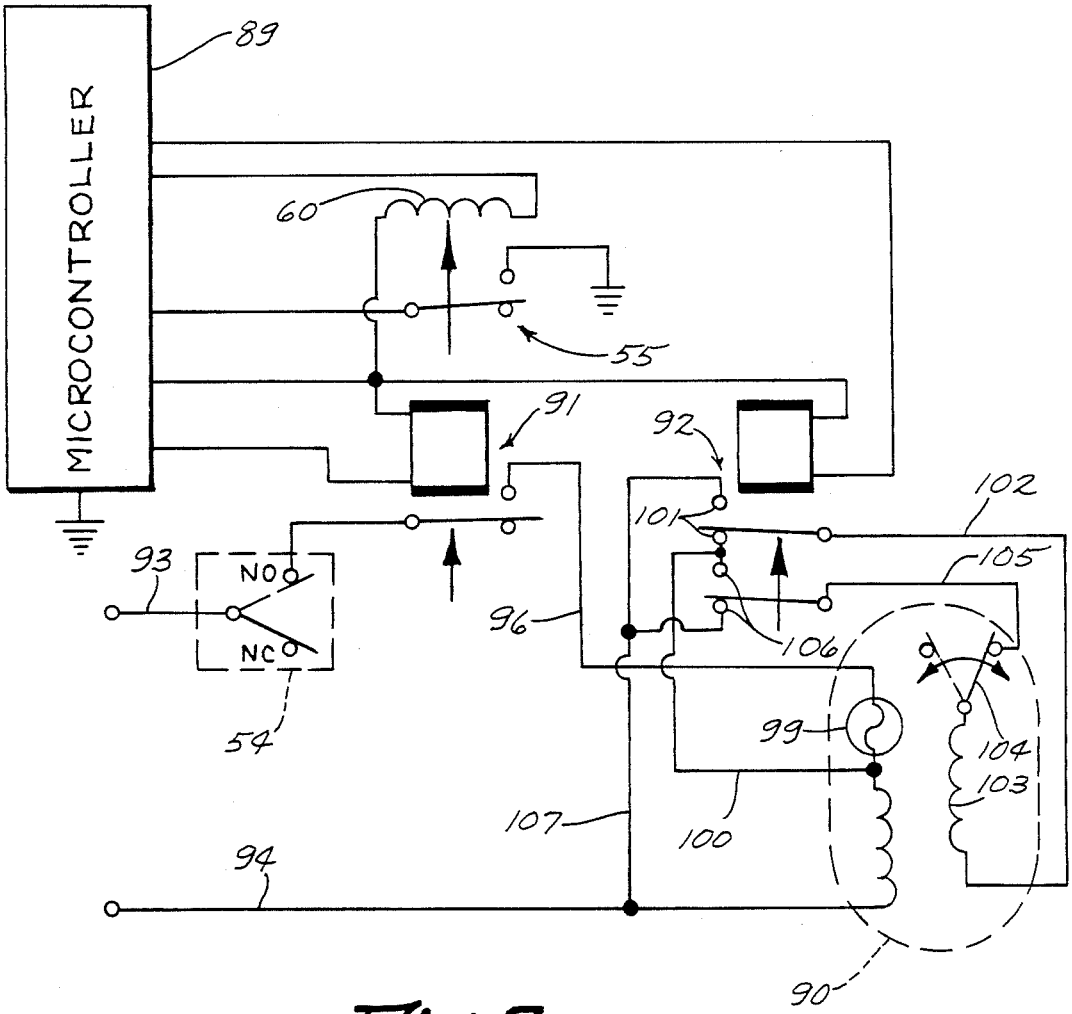
FIG. 7 is an electrical schematic drawing of the operational circuitry for the access door latching apparatus.

Referring now to FIG. 7, there is shown a partial electric schematic circuit for the washing machine 12 of the instant invention including a microcontroller generally designated by the rectangle 89, access door and lock switches 54 and 55 and a microcontroller operated solenoid 60 utilized in the latching mechanism 52. The circuit further includes a drive motor 90, a run relay 91 and a spin or directional relay 92 for the washing machine 12. In the washer/dryer combination shown in FIG. 1, the washer and dryer drive motors are separately connected to 120 VAC through individual power cords. The low voltage power supply for the microcontroller 89 is taken from the dryer line circuit and a low voltage interconnection, 24 VDC in this embodiment, is made between the microcontroller 89 and the low voltage relays 91 and 92 and solenoid 60.

In the circuit of FIG. 7, 120 VAC electrical power is supplied to the washing machine 12 between conductors 93 and 94. The general operation of the control circuitry can best be described in conjunction with the mechanical actuation of portions of the latching mechanism 52 through the access door 19 and energization of the low voltage solenoid 60 which is controlled by the microcontroller 89.

The washing machine 12 and the microcontroller 89 are initially powered by pressing a cycle selection pad associated with the control panel 22 mounted on the fabric dryer 10 and as generally shown in outline form in FIG. 1. Prior to pressing a cycle selection pad, the access door 19 is closed by manually sliding it forward in the guideways 26 of the top cover 16 to pass the catch hook 51 through a slot 95 in the forward wall of the rectangular depression 25 for physically engaging the tapered cam segment 84 of the catch hook 51 with the radiused center portion 83 of the access door switch lever 56. Closing the access door 19 in this manner will cause the tapered cam segment 84 of the catch hook 51 to pivot the access door switch lever 56 clockwise in the slot 81 to the dashed line posture of FIG. 6 and move the access door switch 54 from the normally closed to the normally open contact as shown in dashed line posture in FIG. 7.

As a cycle of operations is initiated by the microcontroller 89, the lock switch 55 is addressed or interrogated by the microcontroller 89 to ensure that the switch contacts are open as they should be prior to actuating solenoid 60 to close the contacts of lock switch 55 and latch the access door 19 by pivoting the access door latch lever 59. This preprogrammed check is made to verify that the contacts of the lock switch 55 are not welded shut or otherwise defeated. After the contacts of the lock switch 55 have been checked and verified open, the solenoid 60 is energized by the microcontroller 89 to pivot the access door latch lever 59 in a counterclockwise direction about the slot 71 in the third flange 62 of the mounting bracket 65 for moving the tab 74 into operating engagement with the actuator button 75 of the lock switch 55. The upper extremity of the second leg 76 of the L-shaped access door latch lever 59 will be moved into locking engagement with the edge 79 of the catch hook 51. The contacts of the lock switch 55 are now closed and a circuit path is completed from the microcontroller 89 through the lock switch 55 to ground. This circuit path to ground indicates to the microcontroller 89 that the access door 19 has been closed and locked.

If the access door 19 is not in the closed posture, the access door switch lever 56 will remain in the full line posture of FIG. 6. With the switch lever 56 in the full line posture when the solenoid 60 is actuated, the angularly extending stop portion 85 of the access door switch lever 56 will engage the abutment 86 on the second leg 76 of the L-shaped access door latch lever 59. This action will block actuation or closing of the lock switch 55 and, as the preprogrammed microcontroller 89 continues to verify the condition of the lock switch 55, it will be determined that the access door 19 is not in a lockable position and the selected cycle will not be initiated.

When the condition of the lock switch 55 has been checked by the microcontroller 89 to verify that the access door 19 is closed and locked, the microcontroller 89 will initiate the energization of the run and/or spin relays 91 and/or 92 depending on the cycle selected. If, for example, a cycle requiring agitation is selected, the microcontroller 89 will first energize a tub fill circuit (not shown) which will fill the tub 30 of the washing machine 12 to the proper water level for washing clothes. Once the fill operation has been completed, the run relay 91 will be energized to complete a circuit from conductor 93, through the access door switch 54 which has been moved to the dashed line normally open posture by the access door switch lever 56, through the now closed contacts of the run relay 91, through conductor 96, thermoprotector 99, conductor 100, first spin relay contact 101, conductor 102, start winding 103, centrifugal switch 104, conductor 105, second spin relay contact 106, and conductor 107 to conductor 94. Once the drive motor 90 reaches run speed, the centrifugal switch 104 will open and the start winding 103 will drop out of the circuit.

If a cycle selection calls for spin or rotation of the drive motor 90 in the reverse direction, the microcontroller 89 will first energize the spin relay 92 to move the first and second switch contacts 101 and 106 in the direction of the arrow to a second posture. The run relay 91 will then be energized to complete the run circuit for the drive motor 90 but in an opposite direction of rotation from agitate since the start winding 103 will be energized in the reverse direction.

It can thus be seen that the instant invention provides control system for operating a washing machine and for ensuring that the access door is locked and that sensor switches are properly operable. A microcontroller-based control is programmed to initially verify the condition and posture of contacts associated with a lock switch and to continually verify these contacts throughout preselected portions of various cycles of operation. When the lock switch contacts have been initially verified, a solenoid is actuated under control of the microcontroller-based control to actuate an access door latch lever for locking the access door and closing the contacts of the lock switch signalling the control that the access door is closed and locked. The control is operable for interrupting operation of the washing machine upon detecting an inoperable lock switch or an unlocked access door during the preselected portions of the cycles of operation.

In the drawings and specification, there has been set forth a preferred embodiment of the invention and although specific terms are employed these are used in a generic and descriptive sense only and not for purposes of limitation. Changes in the form and proportion of parts as well as the substitution of equivalents are contemplated as circumstances may suggest or render expedient without departing from the spirit or scope of the invention as further defined in the following claims.

We claim:

1. A washing machine including a control system for operation of said washing machine through a cycle of operations and for ensuring that an access door is closed and locked during predetermined portions of said cycle of operations and for ensuring that sensor switches associated therewith are properly operable, the combination comprising: cabinet means associated with said washing machine including a top cover defining an access into washing apparatus; an access door mounted on said top cover and movable between access-open and access-closed positions; circuit means including microcontroller-based program means for controlling said washing machine through said cycle of operations; latch means operable under control of said program means with said access door in the access-closed position for locking said access door in said access-closed position; switch means associated with said circuit means and actuatable from a first posture to a second posture by said latch means upon locking of said access door to provide a door-latched signal to said program means; and means for interrogating said switch means prior to said actuation and for receiving a verification signal with said switch means in said first posture to confirm the proper operability of said switch means upon receiving the door-latched signal, said program means being operable for verifying the second posture of said switch means throughout at least preselected portions of said cycle of operations whereby said circuit means is operable for interrupting operation of the washing machine upon detecting an inoperable switch means or an unlocked access door during said preselected portions.

2. A washing machine including a control system as defined in claim 1 wherein said circuit means further includes a switch electrically connected across a power source and operable upon moving said access door to the access-closed position for conditioning the washing machine for operation by providing line current thereto.

3. A washing machine including a control system as defined in claim 1 wherein said circuit means further includes a solenoid electrically associated with said program means and cooperable with said latch means for locking said access door in said access-closed position.

4. A washing machine including a control system for operation of said washing machine through a cycle of operations and for ensuring that an access door is closed and locked during predetermined portions of said cycle of operations and for ensuring that sensor switches associated therewith are properly operable, the combination comprising: cabinet means associated with said washing machine including a top cover defining an access into washing apparatus; a sliding access door mounted on said top cover and slidably movable between access-open and access-closed positions; latch means operable under control of said program means with said access door in the access-closed position for locking said access door in said access-closed position; circuit means including microcontroller-based program means for controlling said washing machine through said cycle of operations; switch means associated with said circuit means including a first switch electrically connected across a power source and operable upon moving said access door to the access-closed position for conditioning the washing machine for operation by providing line current thereto, said switch means further including a second switch in electrical communication with said program means but electrically isolated from said first switch and actuatable from a first to a second posture by said latch means upon locking said access door to provide a door-latched signal to said program means; and means for interrogating said second switch prior to said actuation and for receiving a verification signal with said second switch in said first posture to confirm the proper operability of said second switch upon receiving the door-latched signal, said program means being operable for verifying the second posture of said second switch throughout at least preselected portions of said cycle of operation.

5. A washing machine including a control system as defined in claim 4 wherein said circuit means further includes a solenoid electrically associated with said program means and cooperable with said latch means for locking said access door in the access-closed position.

6. A washing machine including a control system for operation of said washing machine through a cycle of operations and for ensuring that an access door is closed and locked during predetermined portions of said cycle of operations and for ensuring that sensor switches associated therewith are properly operable, the combination comprising: cabinet means associated with said washing machine including a top cover defining an access into washing apparatus; a sliding access door mounted on said top cover and slidably movable between access-open and access-closed positions; latch means operable under control of said program means with said access door in the access-closed position for locking said access door in said access-closed position; circuit means including microcontroller-based program means for controlling said washing machine through said cycle of operations and further including a first source of power for powering said program means and a second source of power for powering said washing machine, said circuit means still further including solenoid means electrically associated with said program means and cooperable with said latch means for locking said access door in the access-closed position; a first switch in circuit with said second source of power and operable upon positioning said access door in the access-closed position for providing power to said washing machine; a second switch in circuit communication with said program means but electrically isolated from said first switch and actuatable from a first to a second electrical posture by said latch means upon locking said access door to provide a door-latched signal to said program means; and means for interrogating said second switch prior to said actuation and for receiving a verification signal with said second switch in said first posture to confirm the proper operability of said second switch upon receiving the door-latched signal, said program means being operable for verifying the second posture of said second switch throughout at least preselected portions of said cycle of operations.

* * * * *